United States Patent [19]

Kessler et al.

[11] Patent Number: 4,503,826

[45] Date of Patent: Mar. 12, 1985

[54] FUEL INJECTION APPARATUS

[75] Inventors: David R. Kessler, Churchville; David W. Beiswenger, Brockport; Andrew J. Makusij, Fairport, all of N.Y.

[73] Assignee: General Motors Corporation, Detroit, Mich.

[21] Appl. No.: 256,563

[22] Filed: Apr. 22, 1981

[51] Int. Cl.[3] ..... F02M 51/02

[52] U.S. Cl. ..... 123/470; 239/124; 239/132.5

[58] Field of Search ..... 123/470, 471, 472, 514, 123/478; 239/124, 132.5

[56] References Cited

U.S. PATENT DOCUMENTS

| | | | |
|---|---|---|---|
| 2,897,800 | 8/1959 | Haas | 123/470 |
| 3,125,078 | 3/1964 | Reiners | 123/470 |
| 3,785,354 | 1/1974 | Moulds | 123/478 |
| 4,186,708 | 2/1980 | Bowler | 123/445 |
| 4,212,277 | 7/1980 | Melotti | 123/472 |
| 4,246,877 | 1/1981 | Kennedy | 123/470 |

FOREIGN PATENT DOCUMENTS

| | | | |
|---|---|---|---|
| 2031064A | 4/1980 | United Kingdom | 123/470 |

*Primary Examiner*—Charles J. Myhre
*Assistant Examiner*—Magdalen Moy
*Attorney, Agent, or Firm*—C. K. Veenstra

[57] ABSTRACT

An electronic injector drive module mounted on a fuel injection assembly is cooled by fuel flow through the assembly.

3 Claims, 1 Drawing Figure

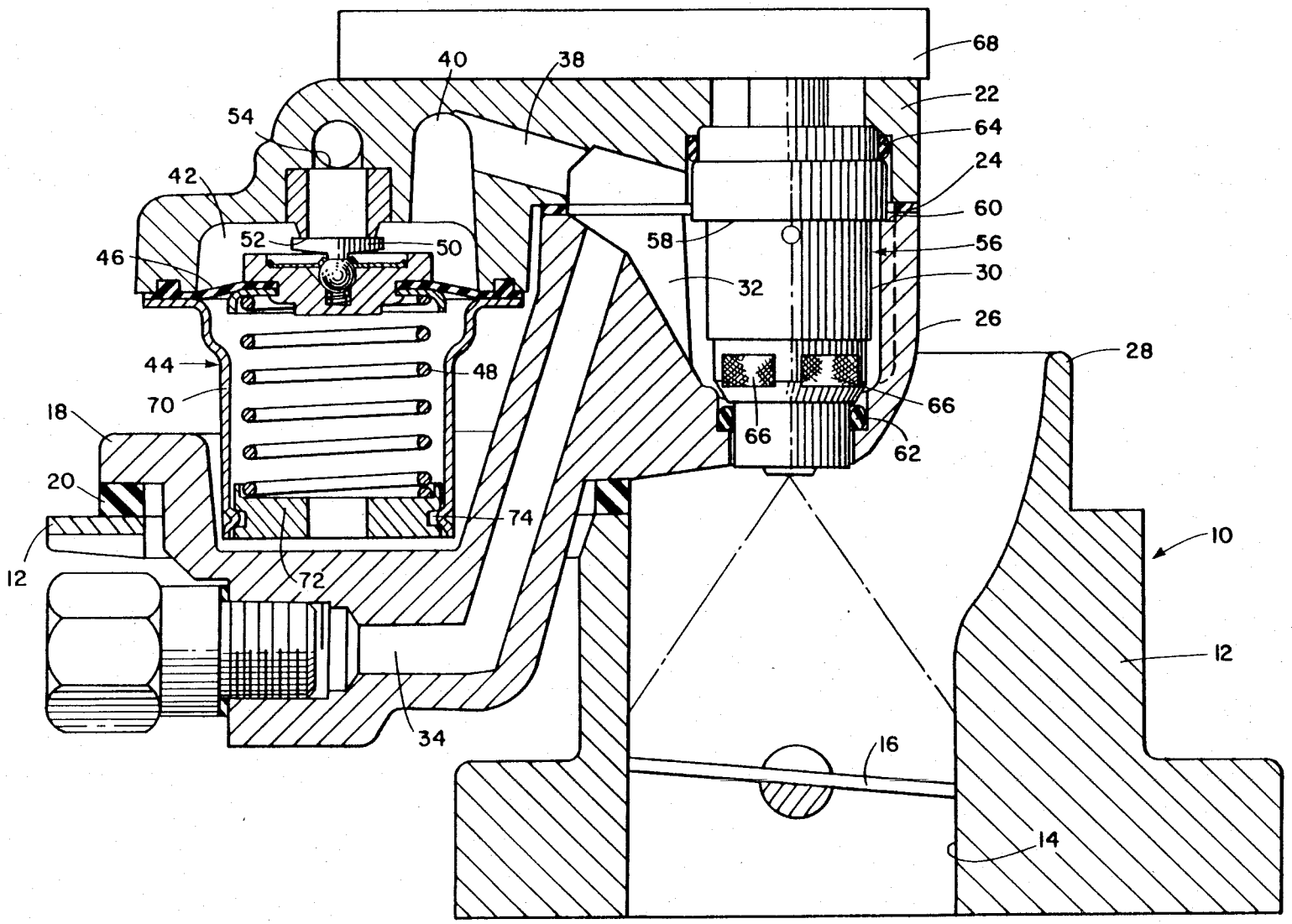
10
12
28
14
68
22
64
24
60
56
30
26
66
62
16
66
32
58
38
40
50
48
74
34
72
54
52
42
46
44
70
18
20
12

FUEL INJECTION APPARATUS

TECHNICAL FIELD

This invention relates to apparatus having an electronically operated injector for delivering fuel to an engine induction passage.

BACKGROUND

In fuel injection apparatus having an injector delivering fuel to an engine induction passage, the presence of fuel vapor bubbles in the liquid fuel supplied to the injector may adversely affect fuel delivery by the injector. Accordingly, particular care is taken to avoid heating or otherwise handling the fuel in a manner which would generate fuel vapor bubbles.

In addition, in fuel injection apparatus having an electronic drive module for operating an injector, provision must be made to cool at least some of the electronic components within the electronic module to prevent excessive temperatures within the module. In one proposal for cooling an electronic injector drive module, represented by U.S. Pat. No. 3,785,354, heat generated by the module was conducted through an air inlet throttle body, and air flow through the throttle body absorbed and carried the heat into the engine. However, such a method of cooling an electronic injector drive module has not been considered practical in apparatus where fuel supplied to the injector flows through passages formed in the throttle body.

SUMMARY OF THE INVENTION

This invention provides fuel injection apparatus having an electronically operated injector and in which an electronic injector drive module is mounted directly on the fuel injection apparatus and is cooled by fuel flow through the apparatus. This abrupt departure from prior practice is made possible because, with this invention, the heat generated in the electronic module is absorbed primarily by excess fuel flow through the apparatus, and the fuel supplied to the injector remains cool.

The preferred embodiment of this fuel injection apparatus, as depicted herein, includes an assembly of heat conductive material formed with a fuel supply passage, an injector cavity receiving fuel from the supply passage, and an excess fuel passage also receiving fuel from the supply passage. Fuel is circulated from the supply passage through the excess fuel passage, and an electronically operated injector delivers fuel from the injector cavity. The electronic module is mounted in maximum heat transfer relation to the assembly adjacent the excess fuel passage so that the assembly conducts heat away from the module to prevent excessive temperatures in the module and so that fuel circulating through the excess fuel passage absorbs and directs the heat away from the injector cavity to avoid generation of fuel vapor bubbles in the injector cavity.

The details as well as other features and advantages of this invention are set forth in the remainder of the specification and are shown in the accompanying drawing.

SUMMARY OF THE DRAWING

The sole FIGURE of the drawing is a sectional elevational view of fuel injection apparatus employing this invention.

BEST MODE FOR CARRYING OUT THE INVENTION

Referring to the drawing, an assembly 10 includes a die cast aluminum throttle body 12 defining an internal combustion engine induction passage 14 controlled in the usual manner by a throttle 16. A die cast aluminum fuel body 18 is mounted on throttle body 12 and separated therefrom by a gasket 20, and a die cast aluminum cover 22 overlies fuel body 18 and is separated therefrom by a heat insulating peripheral sealing gasket 24.

Fuel body 18 includes an injector pod 26 which projects through an upstanding rim 28 formed on throttle body 12 and into induction passage 14 above throttle 16.

Upwardly opening portions of an injector cavity 30 within injector pod 26 and a lateral pocket 32 interconnected with injector cavity 30 are formed during the casting of fuel body 18, and matching downwardly opening portions of injector cavity 30 and pocket 32 are formed during the casting of cover 22. A fuel supply passage 34 is drilled in fuel body 18 to deliver fuel to pocket 32, and an excess fuel passage 38 is drilled in cover 22 from pocket 32 to an access region 40 of a pressure regulator chamber 42. It should be appreciated that pocket 32 is formed in the shape of a slot having dimensions adequate to avoid a pressure difference between the top and bottom of injector cavity 30.

A pressure regulator assembly 44 has a diaphragm 46 secured to cover 22 to close pressure regulator chamber 42. Diaphragm 46 is engaged and biased upwardly by a coil spring 48 and carries a valve member 50 which cooperates with a valve seat 52 that surrounds the outlet 54 from chamber 42.

Fuel supplied through passage 34 circulates through pocket 32, excess fuel passage 38, access region 40 and the remainder of chamber 42 to outlet 54. Diaphragm 46 positions valve member 50 to control fuel flow past valve seat 52 so that the pressure of the fuel in chamber 42 is balanced with the bias of spring 48. Pressure regulator assembly 44 thereby maintains fuel at substantially constant pressure in chamber 42, pocket 32 and injector cavity 30.

An electromagnetic injector 56 is disposed in injector cavity 30 and has a shoulder 58 which is supported on a ledge 60 near the top of fuel body 18. An O-ring 62 provides a seal between injector 56 and fuel body 18 below injector cavity 30, and an O-ring 64 provides a seal between injector 56 and cover 22 above injector cavity 30. When energized, injector 56 receives fuel from injector cavity 30 through screened openings 66 and delivers the fuel in a hollow conical spray pattern into induction passage 14.

This construction of fuel body 18 and cover 22 provides substantial savings in manufacture. In a prior construction, a small portion of the fuel was circulated from a supply passage through a pocket and an excess fuel passage to a pressure regulator, but most of the fuel was circulated from the supply passage to the injector cavity and then from the injector cavity through the pocket and the excess fuel passage to the pressure regulator. Thus in that prior construction, it was necessary to drill the supply passage in one branch which extended to the pocket and in a second branch which extended to the injector cavity, and it was also necessary to drill both a fuel passage from the injector cavity to the pocket and an excess fuel passage. With the present construction, however, pocket 32 is interconnected with injector cavity 30 during the die casting operation, and supply passage 34 is drilled only to pocket 32; pocket 32 supplies fuel to injector cavity 30 as it is required by injector 56. Nevertheless, with this construction circulation of fuel from supply passage 34 through pocket 32 and excess fuel passage 38 removes the heat generated by electromagnetic injector 56 and avoids generation or accumulation of fuel vapor bubbles which might otherwise adversely affect fuel delivery by injector 56.

Electromagnetic injector 56 is operated by an electronic drive module 68 mounted directly on cover 22. Electronic module 68 is not insulated from cover 22 but instead is mounted in maximum heat transfer relation to cover 22 in order that heat generated in electronic module 68 may be conducted into cover 22. Fuel circulating from supply passage 34 through pocket 32 and excess fuel passage 38 absorbs such heat and directs it away from injector cavity 30. Electronic module 68 is thus cooled by fuel circulating through assembly 10 to prevent excessive temperatures within module 68, and the fuel circulating through assembly 10 conducts the heat away from injector cavity 30 to avoid generation of vapor bubbles in cavity 30 which might otherwise adversely affect fuel delivery by injector 56.

Pressure regulator assembly 44 also includes a spring housing 70 surrounding both spring 48 and a spring seat 72 which engages the lower end of spring 48. Before assembling cover 22 to fuel body 18, cover 22 with its pressure regulator assembly 44 is installed in a fixture, and the pressure desired in pressure regulator chamber 42, pocket 32 and injector cavity 30 is established by moving spring seat 72 upwardly to the position which causes spring 48 to create the required bias on diaphragm 46. Spring seat 72 is then held at that position and spring housing 70 is secured to spring seat 72, either by staking or otherwise deforming housing 70 into a peripheral recess or groove 74 formed about spring seat 72 as shown here, or otherwise as by welding housing 70 to spring seat 72 for example. With this construction, pressure regulator assembly 44 may be factory adjusted to accurately set the desired fuel pressure, and subsequent tampering with that adjustment is inhibited. After adjustment, cover 22 is removed from the fixture and secured to fuel body 18 to complete the assembly.

The embodiments of the invention in which an exclusive property or privilege is claimed are defined as follows:

1. Apparatus for delivering fuel to an engine induction passage comprising an assembly having a fuel supply passage and an injector cavity receiving fuel from said supply passage, said assembly including a portion formed of heat conductive material and having an excess fuel passage also receiving fuel from said supply passage whereby fuel is circulated from said supply passage through said excess fuel passage, an electronically operable injector supported in said cavity, said injector having an opening receiving fuel from said cavity and being operable to deliver such fuel to said induction passage, and a heat generating electronic module adapted to operate said injector, and wherein said module is mounted in maximum heat transfer relation to said portion of said assembly adjacent said excess fuel passage whereby said portion of said assembly conducts heat away from said module to prevent excessive temperatures in said module, whereby said portion of said assembly conducts heat from said module along flow paths remote from said injector opening, and whereby fuel circulating through said excess fuel passage absorbs and directs such heat away from said cavity to avoid generation of fuel vapor bubbles in said cavity adjacent said injector opening which might otherwise adversely affect fuel delivery by said injector.

2. Apparatus for delivering fuel to an engine induction passage comprising a fuel body having a fuel supply passage and an injector cavity receiving fuel from said supply passage, an electronically operable injector supported in said cavity, said injector having an opening receiving fuel from said cavity and being operable to deliver such fuel to said induction passage, a cover formed of heat conductive material and secured to said fuel body, said cover having an excess fuel passage also receiving fuel from said supply passage whereby fuel is circulated from said supply passage through said excess fuel passage, and a heat generating electronic module adapted to operate said injector, and wherein said module is secured in maximum heat transfer relation to said cover adjacent said excess fuel passage whereby said cover conducts heat away from said module to prevent excessive temperatures in said module, whereby heat is conducted from said module along flow paths remote from said injector opening, and whereby fuel circulating through said excess fuel passage absorbs and directs such heat away from said injector cavity to avoid generation of fuel vapor bubbles in said cavity adjacent said injector opening which might otherwise adversely affect fuel delivery by said injector.

3. Apparatus for delivering fuel to an engine induction passage comprising an assembly having a fuel supply passage, an injector cavity receiving fuel from said supply passage, and an excess fuel passage also receiving fuel from said supply passage whereby fuel is circulated through said assembly, an electronically operable injector supported in said cavity, said injector having an opening receiving fuel from said cavity and being operable to deliver such fuel to said induction passage, and a heat generating electronic module adapted to operate said injector, at least one of said passages being defined by a portion of said assembly formed of heat conductive material, and wherein said module is mounted in maximum heat transfer relation to said portion of said assembly whereby said portion of said assembly conducts heat away from said module to prevent excessive temperatures in said module, and whereby fuel circulating through said assembly absorbs and directs such heat away from said assembly to avoid generation of fuel vapor bubbles in said cavity adjacent said injector opening which might otherwise adversely affect fuel delivery by said injector.

* * * * *